United States Patent [19]

LaFleur

[11] 4,279,183

[45] Jul. 21, 1981

[54] ROTARY HEAT CUTTER FOR PLASTIC WEBS

[75] Inventor: Arthur E. LaFleur, Manistee, Mich.

[73] Assignee: Custom Packaging Systems, Manistee, Mich.

[21] Appl. No.: 88,372

[22] Filed: Oct. 26, 1979

[51] Int. Cl.[3] ..... B26F 3/08; B26D 7/14

[52] U.S. Cl. ..... 83/16; 83/98; 83/171; 83/175; 83/324

[58] Field of Search ..... 83/16, 171, 175, 98, 83/99, 18, 24, 155, 324, 325

[56] References Cited

U.S. PATENT DOCUMENTS

| | | | |
|---|---|---|---|
| 2,771,534 | 11/1956 | Schwahn | 83/171 |
| 2,930,878 | 3/1960 | Camerini | 83/171 |
| 3,053,128 | 9/1962 | Manthey | 83/171 X |
| 3,054,441 | 9/1962 | Gex et al. | 83/171 X |
| 3,146,283 | 8/1964 | DaValle | 83/171 X |
| 3,546,742 | 12/1970 | Kugler | 83/171 X |

FOREIGN PATENT DOCUMENTS

| | | | |
|---|---|---|---|
| 2263623 | 7/1974 | Fed. Rep. of Germany | 83/171 |

*Primary Examiner*—J. M. Meister

*Attorney, Agent, or Firm*—Barnes, Kisselle, Raisch & Choate

[57] ABSTRACT

The rotary heat cutter comprises a heating element adapted to be rotated into engagement with a taut section of plastic web to sever the web transversely while the web is traveling in a straight path. Means are provided for constraining the heating element to move at the same speed as the plastic web when the heating element engages the web.

27 Claims, 7 Drawing Figures

P

ROTARY HEAT CUTTER FOR PLASTIC WEBS

This invention relates to an apparatus and method for severing plastic web material into successive sheets.

In the manufacture of plastic bags and the like a continuous web of plastic sheet material is fed from a supply roll to a cut-off mechanism which includes a blade or knife that cuts the web into individual sheets of desired length. The sheets are thereafter heat sealed or sewn into finished bags. Some sheet material is in the form of a woven web. When such woven web material is sheared to length by a blade or knife the severed ends of the woven strands tend to unravel. It is therefore frequently necessary to hem the end of such woven sheets before further processing.

The present invention has for its object the elimination of the step of hemming or otherwise processing the ends of such woven plastic sheets by severing the web by means of a heating element which tends to fuse the ends of the severed strands together.

Another object of the invention is to heat sever a continuous web of plastic into successive sheets rapidly and in an accurate manner.

A further object of this invention is to provide a machine and method for heat severing plastic which is readily adjustable for severing sheets of different lengths.

More specifically, the machine of the present invention comprises a heating element which is continuously rotated into contact with a continuously advancing web of plastic sheet material so as to periodically sever the web transversely into successive sheets of pre-determined length. One of the important features of the machine resides in the provision of a rotary drive for the heating element the speed of which is adjustable relative to the speed of the web for varying the length of the successive sheets severed from the web. At the same time the rotary drive for the heating element is designed to constrain the heating element to travel at the same lineal speed as the web when the heating element engages the web. Another feature of the machine resides in an arrangement for maintaining a portion of the web in a straight taut condition and causing the rotating heating element to engage the web, deflect and sever it at the straight section thereof without utilizing a backing member such as a backup roll for the heating element.

Further objects, features and advantages of the present invention will become apparent from the following description and accompanying drawings, in which.

Figures 1, 2:
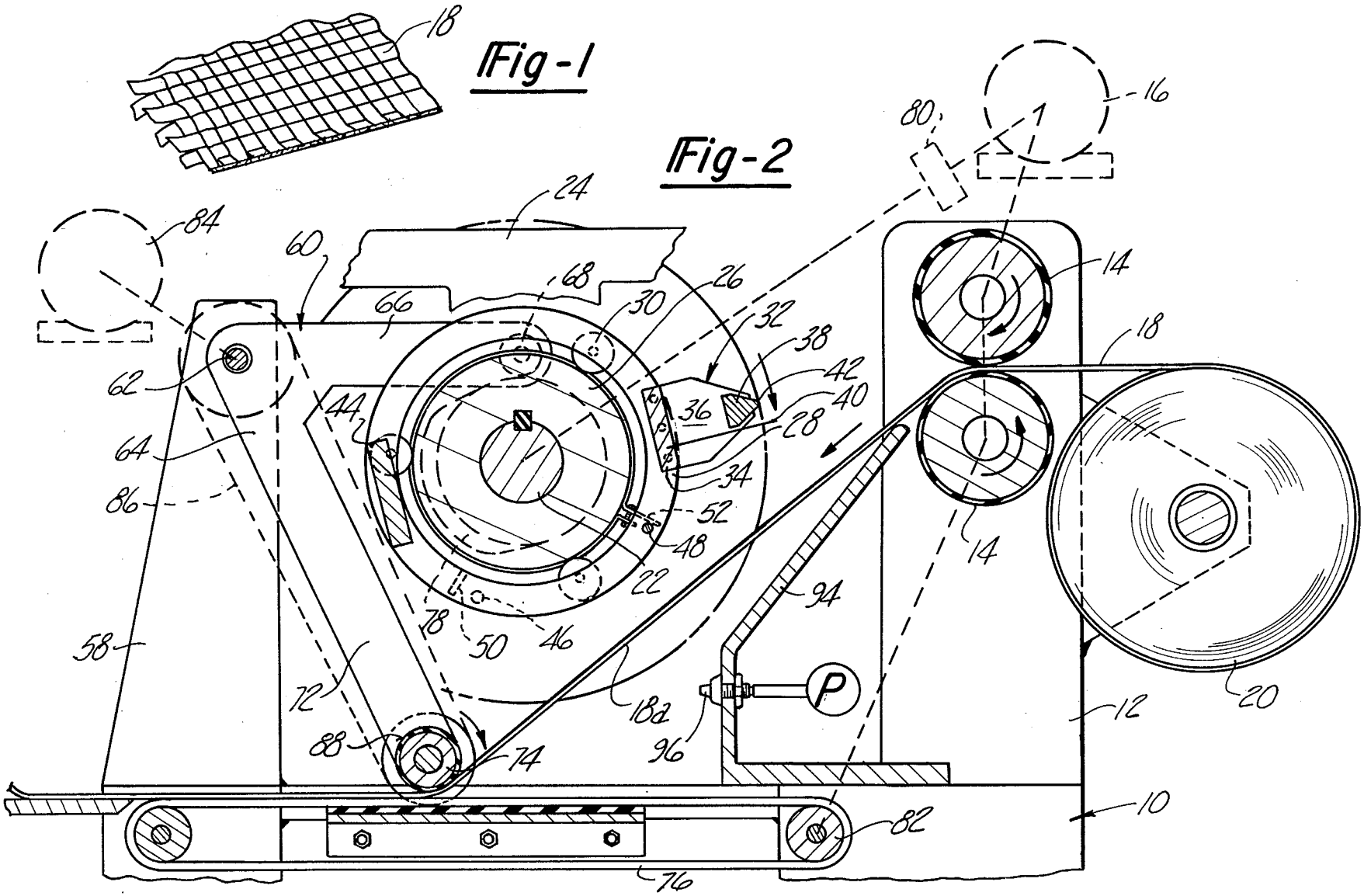
FIG. 1 is a fragmentary perspective view of a portion of plastic web adapted to be severed by the machine and method of the present inventon.
FIG. 2 is a fragmentary side elevational view partly in section and partly diagrammatic of a machine according to the present invention.
Figure 3:
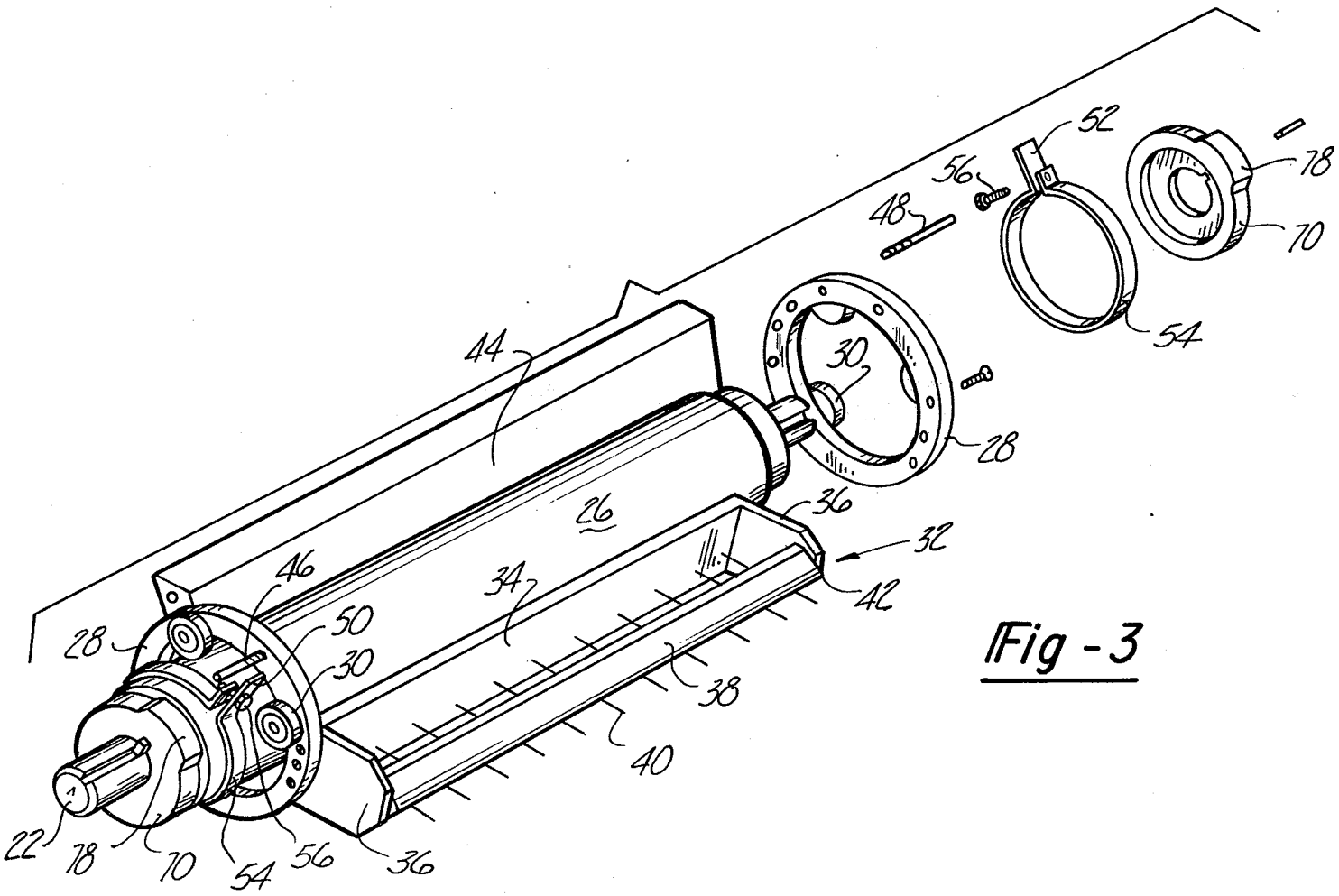
FIG. 3 is an exploded perspective view of the rotary drum and heating element of the machine.

Referring first to FIG. 2 the machine of the present invention generally comprises a base 10 having an upright pedestal 12 at one end on which a pair of feed rolls

14 are journalled on horizontal axes. Feed rolls 14 are rotated by a suitable drive from a motor 16. A web 18 of woven plastic fabric extends between feed rolls 14 and is adapted to be advanced thereby in a downwardly direction from a supply roll 20. A drive shaft 22 is journalled between a pair of upright side frames 24 on base 10. Drive shaft 22 is journalled for rotation about an axis parallel to the axes of feed rolls 14. A cylinder drum 26 is keyed to shaft 22 to rotate therewith. Adjacent each of the opposite ends of drum 26 a ring 28 is rotatably supported on the drum by a plurality of bearing rollers 30. The two rings 28 are interconnected by a bearing assembly 32 which comprises a longitudinally extending bar 34 secured at its opposite ends to rings 28 and having radially extending legs 36. An electrical resistance heating element 38 is secured to and extends between the outer ends of legs 36. A plurality of web impaling needles 40 are mounted on bar 34 and project radially outwardly slightly beyond the nose 42 of heating element 38. Needles 40 are spaced slightly in advance of heating element 38 relative to the direction of rotation.

Diametrically opposite the heating element assembly 32 there is secured to the rings 28 a counterweight bar 44. Bar 44 is of sufficient weight to overbalance heating element assembly 32 so that the gravitational forces thereon tend to rotate the assembly mounted on rings 28 to a position wherein the heating element 38 assumes a position above the axis of shaft 32. However rings 28 have axially extending pins 46,48 mounted thereon which are adapted to engage stops 50,52 at the opposite ends of 26 to limit the extent of relative rotation between rings 28 and shaft 22. Stops 50,52 are formed as radial lugs on circumferentially extending bands 54 which are adapted to be clamped to the drum by clamping screws 56. Pins 46,48 are preferably circumferentially offset from one another and the clamping bands 54 are secured to the drum 26 so that the stops 50,52 are circumferentially offset a greater extent than the circumferential offset between pins 46,48. The circumferential offset of stops 50,52 in relation to pins 46,48 determine the extent of relative rotation permitted between heating element assembly 32 and shaft 22.

On the opposite side of base 10 from the pedestal 12 a pair of upright brackets 58 are mounted. A bell crank assembly 60 is pivotally supported on brackets 58 by a shaft 62. Bell crank assembly 60 includes a pair of bell cranks 64 keyed one to each end of shaft 62. Each bell crank has an upper arm 66 having a cam follower roller 68 at its free end adapted to engage a cam 70 keyed to shaft 22 at each end of drum 26. Between the lower ends of the other arms 72 of each bell crank 64 there is journalled a rubber covered tensioning roller 74. Tensioning roller 74 is adapted to engage the top run of an endless rubber belt conveyor 76. Each cam 70 has a radially outwardly extending cam portion 78 which when engaged by the cam follower roller 68 pivots the bell crank assembly 60 in a counterclockwise direction as viewed in FIG. 2 to swing tensioning roller 74 upwardly out of contact with belt conveyor 76.

Shaft 22 is driven by motor 16 through a set of change gears diagrammatically illustrated at 80 so that the peripheral speed of the heating element assembly 32 can be varied in relation to the lineal speed of web 18. Motor 16 also drives the powered roller of belt conveyor 76. The shaft 62 of bell crank assembly 60 is preferably driven by the same motor 16 or by a separate motor 84. Shaft 62 has a chain or belt drive 86 with a slipping clutch 88 which drives tensioning roller 74.

The drives to these various elements are such that the lineal speed of belt conveyor 76 is at least slightly in excess of the lineal speed of web 18 as produced by feed rolls 14 and the periheral speed of tensioning roller 74 is at least slightly in excess of the lineal speed of belt conveyor 76 when the tensioning roller is out of engagement therewith. However the speed of the tensioning roller is reduced to the speed of the conveyor 76 when it contacts the belt. Shaft 22 is preferably driven at a speed such that the peripheral speed of the heating element 38 is normally at least slightly less than the lineal speed of web 18.

Figure 4:
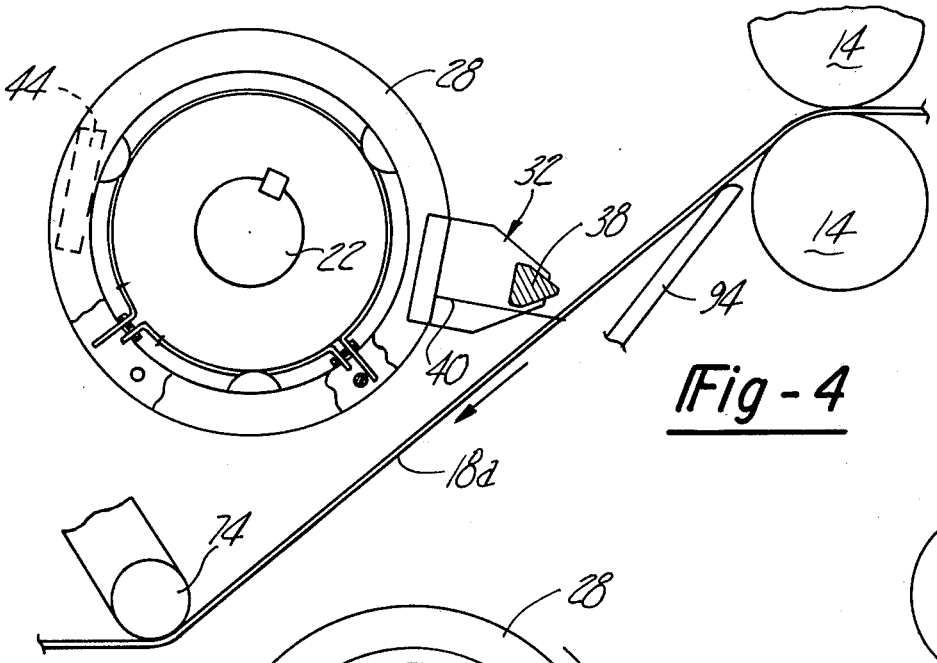
FIGS. 4, 5 and 6 are fragmentary views showing progressive positions of the heating element and the web in the process of severing the web.
Figure 5:
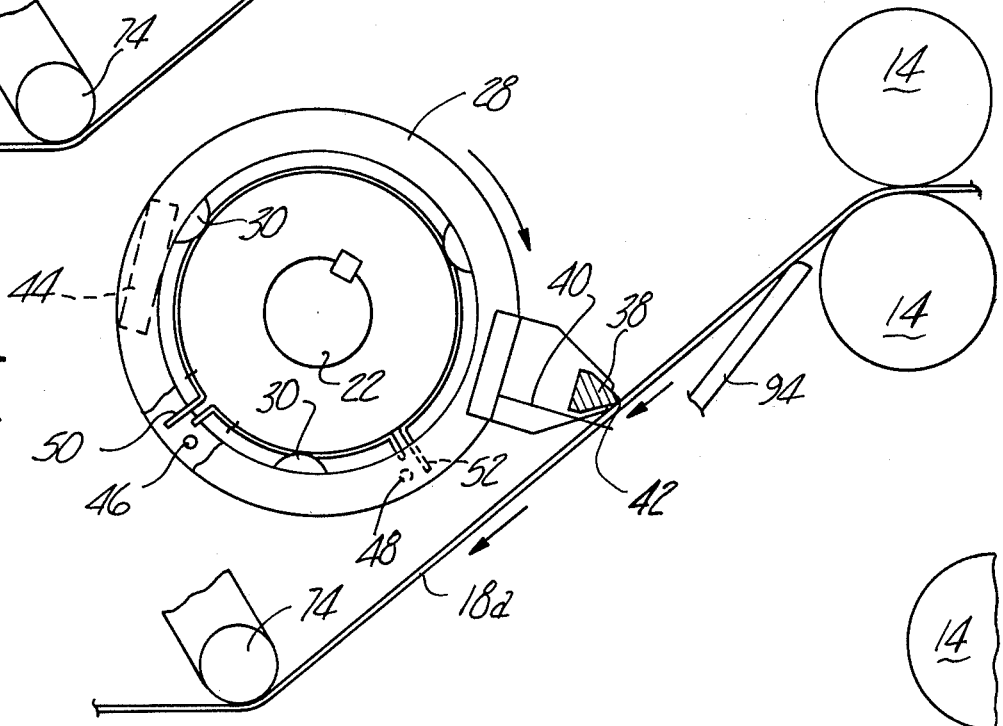

In operation shaft 22 and tensioning roller 74 are driven in a clockwise direction and feed rolls 14 are driven to advance the web 18 from feed roll 20 downwardly toward tensioning roller 74. When the web 18 is engaged between tensioning roller 74 and the top run of belt conveyor 76 the section 18*a* of the web is stretched between feed rolls 14 and tensioning roll 74 since the tensioning roll 74 and belt conveyor 76 have lineal speeds greater than that of the web as fed by feed rolls 14. The radial distance between the plane of the taut web section 18*a* and the axis of rotation of shaft 22 is less than the radial distance between the nose 42 of heating element 38 and the axis of rotation of shaft 22. Thus with the various elements in the positions shown in FIGS. 2 and 4, stop 52 is rotating clockwise and is in engagement with pin 48 to drive the heating element assembly 32 clockwise so that it is moving downwardly toward the straight, taut web section 18*a*.

Figure 6:
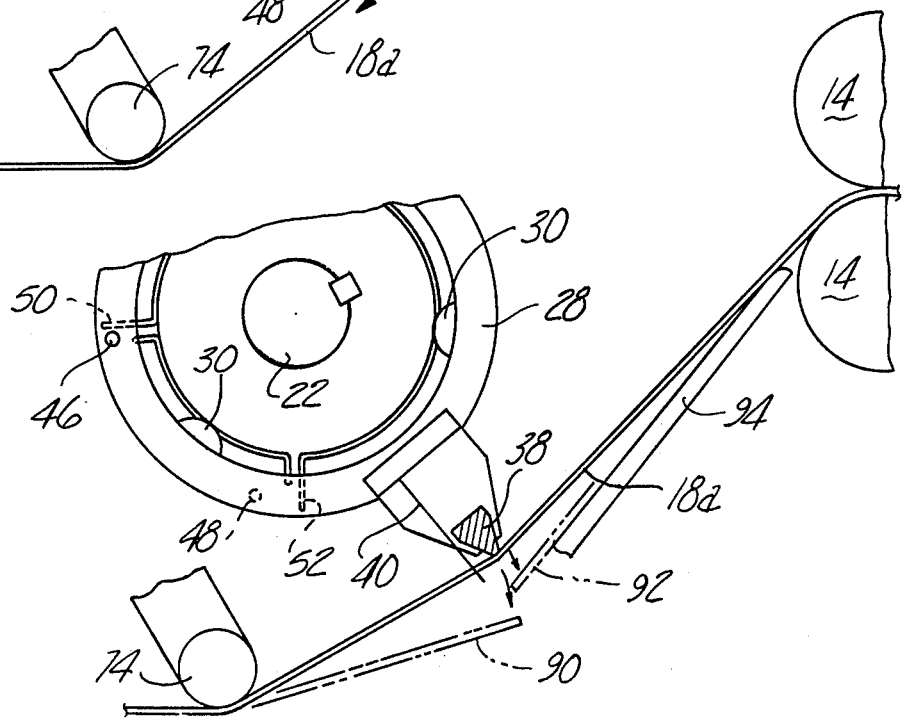
Figure 7:
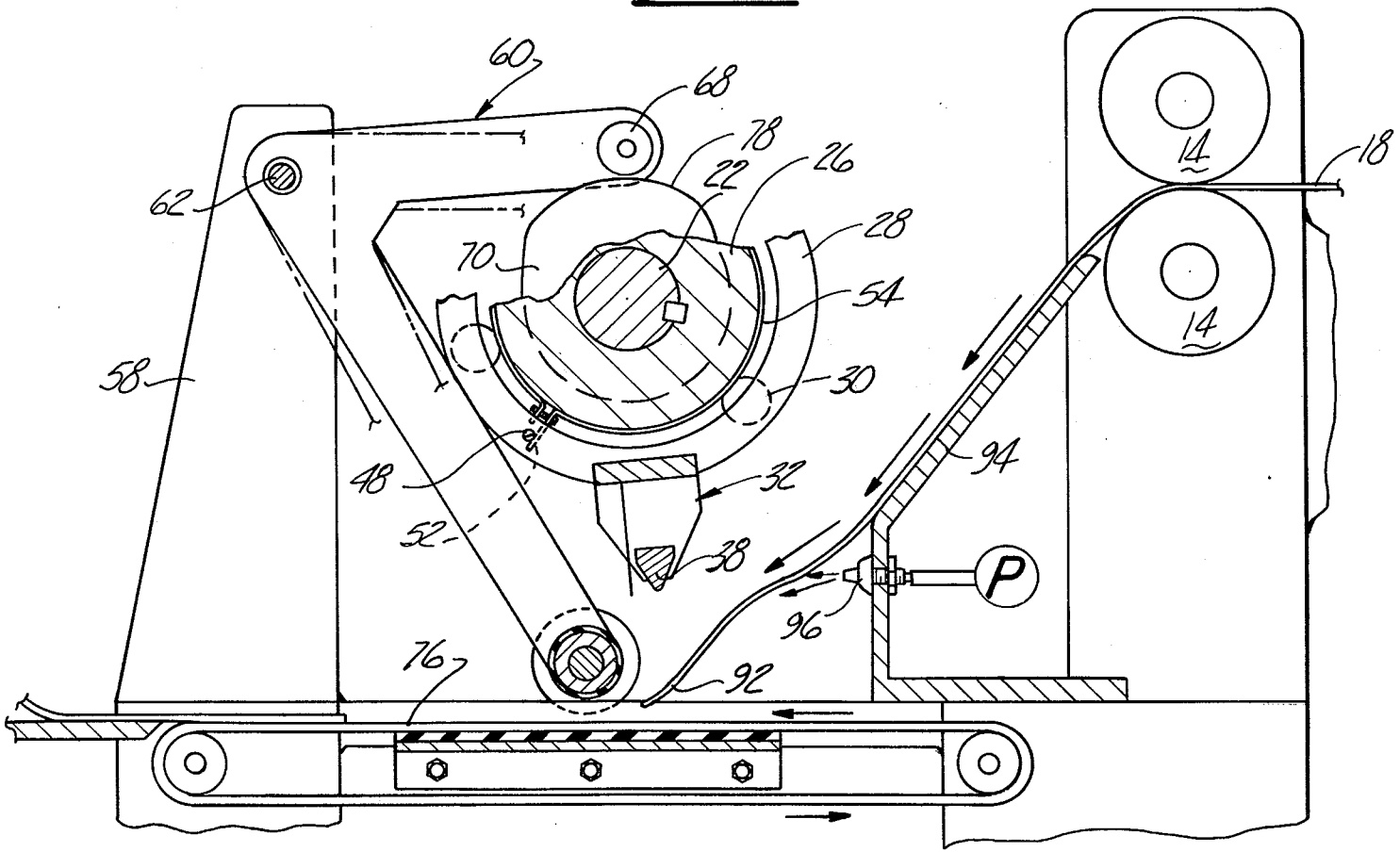
FIG. 7 is a view similar to FIG. 1 and showing the severed leading end portion of the web being advanced after it is severed.

At the position shown in FIG. 2 the peripheral speed of the heating element 38 is less than the lineal speed of web 18. However as soon as the heating element assembly 32 rotates to a position closely adjacent the web section 18*a* (FIG. 4) the needles 40 penetrate through the web section 18*a* and thus constrain the heating element 38 to travel at the same peripheral speed as web section 18*a*. Needles 40 are spaced slightly from heating element 38 so they will not be heated to a temperature such as to tear the web impaled thereon. Thus after needles 40 penetrate through the web section 18*a* pin 48 on the one ring 28 rotates clockwise away from stop 52 and pin 46 rotates clockwise toward the other stop 50. This relative rotation results from the fact that the web is traveling at a speed greater than that at which the heating element is driven by shaft 22. When the heating element engages web 18*a* there is no slippage between the nose 42 of the heating element and the web section 18*a*. Continuous rotation of the heating element causes it to bear with pressure against the web section 18*a* and deflect it as shown in FIG. 6. After a very short interval of time, depending upon the power supplied to the heating element and the lineal speed of the web, the heat generated in the heating element will sever the web transversely and simultaneously fuse together the severed ends of the woven strands on the web.

As soon as the web is severed the trailing edge 90 of the cut sheet is rapidly advanced since the cut sheet is still engaged between the more rapidly moving belt 76 and tensioning roller 74. The leading edge portion 92 of the severed web section 18*a* drops downwardly onto a downwardly inclined guide plate while being advanced by the feed rolls 14. Shortly after the web is severed by the heating element the cam follower rollers 68 engage the cam rise portions 78 on cams 70 to pivot the bell crank assembly 60 in a counterclockwise direction and thus rotate tensioning roller 74 upwardly out of contact with the top run of belt conveyor 76. Substantially simultaneously therewith a jet of air is directed through a nozzle 96 against the underside of the leading portion 92 of the severed web to guide it smoothly onto the top run of belt conveyor 76. Thus the leading edge portion 92 is directed beneath the tensioning roller 74 and is prevented from assuming a folded condition on the belt conveyor. The circumferential extent of the cam rise portions 78 is such that a substantial length of the web has traveled beneath and past the tensioning roller 74 before the roller is again lowered into contact with the web to again stretch it to a straight, taut condition such as shown at 18*a*.

At the moment the web is severed by the heating element the counterweight 44 is located above the axis of shaft 22 but has not reached a position directly above the shaft. Thus, the gravitational forces on counterweight 44 tend to rotate rings 28 and heating element assembly 32 in a counterclockwise direction. However since the rings 28, counterweight 44 and heating element 32 have substantial momentum in a clockwise direction the effect of counterweight 44 is simply to reduce the speed of clockwise rotation of this assembly so that the stop 52 rotates into smooth abuting engagement with pin 48 on ring 28 to again drive the heating element assembly at the same speed as the shaft. Stop 50 is spaced circumferentially from pin 50 to prevent excessive overtravel of the heating element relative to shaft 22.

In the event it is desired to cut the plastic sheets to a greater length it is obvious that the differential between the speed of the heating element 38 and the web 18 must be increased. In the present arrangement this speed differential may be varied by the change gears 80 so as to reduce the speed of shaft 22. When the speed of rotation of the heating element is reduced, the bands 54 are readjusted to increase the circumferential spacing between stops 50,52 to permit a greater relative rotation between heating element 38 and shaft 22 while the web is being severed. It follows that when the shaft 22 is rotated at a speed such that the heating element and the web are driven at close to the same speed the circumferential spacing between stops 50,52 is very close to the circumferential spacing between pins 46,48 to prevent excessive overtravel of the heating element.

I claim:

1. A machine for severing a continuous web of plastic transversely into successive sheets of pre-determined length comprising, a support, a pair of driven feed rolls on said support for advancing said web at a pre-determined lineal speed, a sheet conveyor on said support spaced from and below said feed rolls and to which said web is advanced, means for driving said conveyor so that its lineal speed is at least equal to said pre-determined lineal speed of the web, web tensioning means cooperating with said sheet conveyor and adapted to pull the portion of the plastic web extending between said feed rollers and said conveyor into a stretched, taut condition along a straight path of travel which extends downwardly between said feed rollers and tensioning means and which overlies said conveyor and a heating element driven for rotation about an axis extending generally parallel to and transversely of said straight portion of said web, said heating element being adapted to sever the web when engaged therewith, said straight path of said web being spaced radially from the axis of rotation of the heating element a lesser distance than said heating element so that when the heating element is rotated it engages said straight portion of said web, deflects it radially away from the axis of rotation of the heating element and severs it transversely into successive sheets, said conveyor being adapted to advance the severed sheet in a direction downstream beyond said tensioning means and said feed rolls being adapted to advance the web so that its severed leading edge portion is deposited onto the conveyor at a location upstream of the tensioning means and is advanced by the conveyor so that the web is again stretched to said taut condition when its leading edge portion is engaged by the tensioning means.

2. A machine as called for in claim 1 including means rotatable with said heating element and adapted to grip said straight portion of the web adjacent the section thereof engaged by the heating element so as to constrain the heating element to travel at the same speed as the web until the web is severed by the heating element, a rotary drive shaft and means coupling the heating element and said shaft for driving the heating element at a pre-determined peripheral speed, said coupling means being adapted to permit the heating element to rotate at the lineal speed of the straight portion of the web in the event the peripheral speed of the heating element does not conform to the lineal speed of the web when said gripping means engage said web.

3. A machine as called for in clalim 1 wherein said conveyor comprises an endless belt and said drive means drives the belt at a lineal speed greater than said pre-determined lineal speed of the web.

4. A machine as called for in claim 3 wherein said tensioning means comprises a roller engageable with said conveyor belt and including means for driving the roller so that its peripheral speed is at least equal to the lineal speed of the belt conveyor.

5. A machine as called for in claim 3 wherein said tensioning means comprises a roller engageable with said conveyor belt and including means for driving the roller so that it peripheral speed is greater than the lineal speed of the belt conveyor.

6. A machine as called for in claim 4 including drive means for rotating the heating element and means coupled with the drive means for the heating element to lift the tensioning roller from the belt during a portion of each revolution of the heating element.

7. A machine as called for in claim 6 wherein said lift means are arranged to lift the tensioning roller from the belt for a short time interval after the heating element has engaged and severed the web.

8. A machine as called for in claim 7 wherein said lifting means are adapted to lower the tensioning roller into engagement with the belt after the severed leading end portion of the web has been advanced by the belt conveyor to a location downstream beyond the tensioning roller.

9. A machine as called for in claim 2 wherein said gripping means comprises a plurality of needles located circumferentially adjacent and projecting radially beyond the heating element.

10. A machine as called for in claim 9 wherein said needles are located slightly in advance of the heating element relative to the direction of rotation thereof.

11. A machine as called for in claim 2 wherein said coupling comprises a lost motion rotatable connection between the heating element and the rotary drive shaft.

12. A machine as called for in claim 11 wherein said lost motion connection comprises abutment means on said heating element and said shaft adapted to interengage when the heating element is rotated in opposite directions through a pre-determined circumferential extent relative to said shaft.

13. A machine as called for in claim 12 wherein said abutment means are circumferentially adjustable relative to one another to vary the circumferential extent to which the heating element is rotatable relative to said rotary shaft.

14. A machine as called for in claim 2 wherein said heating element is mounted on a ring member rotatably supported on said shaft, said coupling means comprising abutment means on said ring member and abutment means on said shaft, said abutment means being spaced apart circumferentially to interengage when the ring member rotates through a pre-determined arc in opposite directions relative to said shaft.

15. A machine as called for in claim 14 wherein said ring member is relatively freely rotatable on said shaft through said pre-determined arcuate extent and including means acting on and rotatably biasing the ring member to interengage said abutment means such as to cause the heating element to rotate at the same speed as the shaft at least slightly before the heating element rotates into engagement with said straight portion of said web.

16. A machine as called for in claim 15 wherein said straight portion of said web is inclined downwardly from said feed rolls to said tensioning means and said heating element is rotated so that it is traveling downwardly in the direction of travel of the web when it engages said portion of said web.

17. A machine as called for in claim 16 wherein said biasing means comprises a weight fixed on said ring member and located generally diametrically opposite said heating element, said weight, in response to gravitational forces thereon, tending to rotate the ring member relative to the shaft so that the heating element is biased by the weight to a position above the axis of rotation of the shaft.

18. A machine as called for in claim 17 wherein the lineal speed of the web is greater than the peripheral speed of the heating element.

19. A machine as called for in claim 1 including means located above the conveyor for directing a jet of air against the underside of the severed leading end portion of the web in downstream direction.

20. A machine as called for in claim 19 including means for rendering the tensioning means intermittently inoperative once during each revolution of the heating element and means for energizing the air jet means while the tensioning means are rendered inoperative.

21. The method of severing a continuous plastic web transversely into a plurality of successive sheets comprising feeding web at a substantially uniform lineal speed continuously in one direction between vertically and laterally spaced upstream and downstream points, there being web tensioning means at the downstream point so as to maintain the section of the web moving between said points in a straight, downwardly inclined, taut condition, rotating a heating element continuously in one direction about an axis parallel to and extending transversely of said straight section of the web, the heating element being adapted to sever the straight section of the web transversely when engaged therewith and being spaced from its axis of rotation a distance at least slightly greater than the radial spacing between said axis and said straight section of the web, causing the heating element to rotate into engagement with the straight section of the web while the web is moving at said speed so as to deflect it radially outwardly and thereby sever the web along a transverse line so that the portion of the web downstream of the line of severing forms a discrete sheet, thereafter advancing in a downwardly direction the leading end portion of the web upstream of said line of severing to said web tensioning means to again place a section of the web between said two points in said taut condition before the heating element again rotates into engagement with the web.

22. The method as called for in claim 21 wherein the web is fed at a lineal speed at least slightly different than the peripheral speed of the rotating heating element and including the step of constraining the heating element to travel at the same speed as the web when it engages the web.

23. The method as called for in claim 22 wherein the web is fed at a greater speed than the peripheral speed of the heating element.

24. The method as called for in claim 21 wherein the heating element is rotating downwardly in the direction of the travel of the web when it engages the web.

25. The method called for in claim 24 wherein the leading end portion of the web upstream of said line of severing is directed in a generally horizontal path to said tensioning means.

26. The method called for in claim 25 wherein the leading end portion of the web upstream of said line of severing is advanced to said tensioning means by a belt conveyor located below the path of travel of the heating element.

27. The method called for in claim 26 including the step of directing a jet of air to the underside of the leading end portion of the web upstream of said line of severing, said air jet being directed generally horizontally above and in a downstream direction relative to the conveyor.

* * * * *